US005237714A

United States Patent [19]

Baron

[11] Patent Number: 5,237,714

[45] Date of Patent: Aug. 24, 1993

[54] ORTHOPEDIC PILLOW

[76] Inventor: Martial C. Baron, 3 rue Rosenwald, Paris, France, F-75015

[21] Appl. No.: 807,859

[22] PCT Filed: Jun. 26, 1990

[86] PCT No.: PCT/FR90/00468

§ 371 Date: Jan. 17, 1992

§ 102(e) Date: Jan. 17, 1992

[87] PCT Pub. No.: WO91/01103

PCT Pub. Date: Feb. 7, 1991

[30] Foreign Application Priority Data

Jul. 18, 1989 [FR] France ..... 89 09644

[51] Int. Cl.[5] ..... A47G 9/00

[52] U.S. Cl. ..... 5/636; 5/695

[58] Field of Search ..... 5/636, 690, 644, 645

[56] References Cited

U.S. PATENT DOCUMENTS

| | | | |
|---|---|---|---|
| 2,835,905 | 5/1958 | Tomasson | 5/636 X |
| 3,521,310 | 7/1970 | Greenawalt | 5/636 |
| 3,667,074 | 6/1972 | Emery . | |
| 4,550,459 | 11/1985 | Endel et al. | 5/640 |
| 4,660,239 | 4/1987 | Thomas . | |
| 4,821,355 | 4/1989 | Burkhardt | 5/636 |
| 4,949,411 | 8/1990 | Tesch | 5/645 |
| 5,038,432 | 8/1991 | Robillard et al. | 5/645 |

FOREIGN PATENT DOCUMENTS

| | | |
|---|---|---|
| 0316573 | 5/1989 | Fed. Rep. of Germany . |
| 2148111 | 5/1985 | United Kingdom . |

*Primary Examiner*—Michael F. Trettel

*Attorney, Agent, or Firm*—Hoffman, Wasson & Gitler

[57] ABSTRACT

The present invention relates to an orthopedic pillow having seven functions essential for the prophylaxis and the therapy of difficulties in falling asleep, sleep problems, cervical pain, scapular pain and back pain, when they are associated with cervical-dorsal hypertonies. The orthopedic pillow of the present invention is characterized by its functional shape and by the possibility of adjusting the thickness of its different portions. This adjustment allows to precisely adjust the pillow to all occipital-cervical-dorsal confirmations in a given size.

7 Claims, 1 Drawing Sheet

ORTHOPEDIC PILLOW

BACKGROUND OF THE INVENTION

This invention is that of an orthopedic pillow, i.e., a pillow that can be adjusted to the specific occipito-cervico-dorsal shape of its user to make optimal relaxation of his perivertebral muscles possible.

Numerous pillows have already been described and some marketed to attempt to "provide optimal relaxation of the perivertebral muscles of the user," but none is adjustable to the particular morphology of each individual.

The applicant has carefully considered the problem of adapting a pillow to the particular morphology of its user after having studied the basic shape that is best suited for human rest.

It is increasingly known that postural supports have a great importance in the physiology of rest and in particular cervical supports.

The rachis of a living being is sinusoidal. But apart from any muscular tone, the vertebral column is straight as dorsal decubitus post-mortem studies show.

Simple clinical observation of a standing subject shows a series of lordosis and kyphosis; these latter result mainly from muscular tone which provides at the same time mobility and the physiological limits of the various vertebral segments.

The large amplitudes of the cervical movements and their physiological limits depend especially on the cervical muscles. At the level of the cervical rachis, normally lordotic, all of the vertebrae provide insertion to very many functionally specific muscles; the latter assure at the same time great mobility and postural support of the head throughout the period of wakefulness Maintenance of these functional units involves an effective, recuperative and daily relaxation of the muscles under their optimal conditions of rest.

Cervical lordosis exists naturally on a body in decubitus. Appropriate support of this curvature reduces the activity of the cervical muscles. It makes possible a gain in recuperation during sleep. The sensation of comfort by the subject is one of the evidences.

A large number of long muscles of the back are inserted at the same time at the cervical, dorsal and even lumbar level. The relaxing of the cervical region is thus at the origin of a gain in nocturnal relaxation for all of these pluriarticular muscles. This relaxation is all the more effective as the support structure is used in the various positions of the sleeper, without interfering with the movements of the head and of the body. These movements actually make possible an alternate rest of numerous muscles which would barely be relaxed otherwise.

The neck is comparable to the foot, it has a curvature and length which vary from one person to the next. The applicant observes five major cervical morphotypes:

FLEXIBLE and MOBILE necks whose curvature is standard. They correspond to the normal head bearing of an athlete.

STIFF necks whose curvature is not very pronounced. They correspond to an indistinct cervical lordosis (radiological straight necks).

HYPERLORDOTIC necks. It involves an accentuation of the physiological curvature regardless of the cause.

SHORT necks of the brachycervicals. The musculature of the subject hides his physiological lordosis which can appear only with an X-ray.

ATYPICAL necks that do not fit into any of the above categories.

SUMMARY OF THE INVENTION

The 7 FUNCTIONS of the present invention are as follows:

to fill, in all positions, the natural curvature of the neck as a function of its specific type, to provide a true relaxation of the perivertebral muscles relating to this zone.

to leave the head free of its movements to promote the relaxation of all the cervico-dorsal muscles and to prevent contractions.

to free the shoulders so that they do not push the pillow outside of its cervical support position during sleep and so that the movements of the body are facilitated.

to allow gaseous exchanges of the parts of the body supported to contribute to their natural health.

to have a consistancy reminiscent of the most used traditional pillows so as not to disrupt the habits of the users.

to be easily washed and dried to make possible an ideal hygiene.

to be suited to all occipito-cervico-dorsal shapes by a proper adjustment imparting to it the qualities of an orthosis.

DESCRIPTION OF THE PREFERRED EMBODIMENT

The orthopedic pillow according to the invention is characterized by its shape and the adjustment of the thickness of its various parts, independently of the materials making it up.

The shape of the pillow is characterized by a convex front part, 1 higher than the back portions 2, 3 (see figures). The convexity of the front of this pillow can be double: its convexity upward corresponds to the convexity of the neck and its horizontal convexity makes it possible to free the shoulders. The convex front portion would extend from the bottom 4 to a top portion 5. The back portions extend from 5 to 8.

The transverse convexity of the front face of the pillow according to the invention is characterized by radii of curvatures which can be modified as a function of the cervicoscapular shape of the type of user and of the more or less pronounced hollow of his back at the level of the first dorsal vertebrae.

The depth and the width of the pillow can also be adjusted, if it is necessary, to the size of the user and more particularly to that of his bed.

The case of the pillow invented comprises one or more walls, preferably convex and parallel to the front part so as to create two or more inside compartments.

Figure 1:
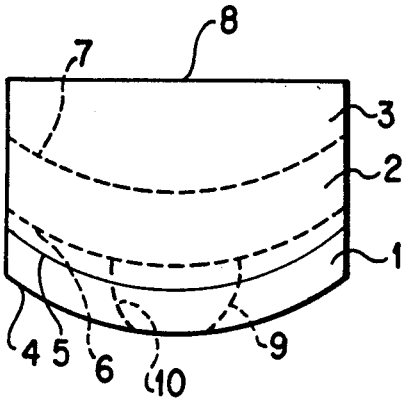
FIG. 1 is a projection view of the pillow of the present invention.
Figure 2:
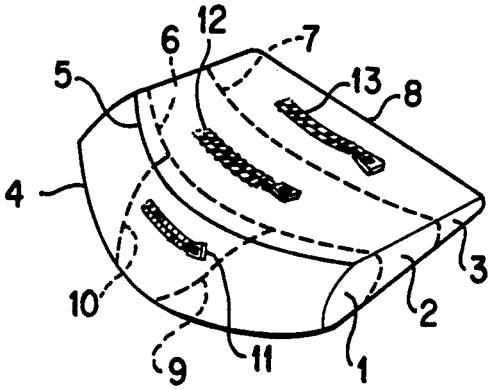
FIG. 2 is a perspective view of the pillow of the present invention.
Figure 3:
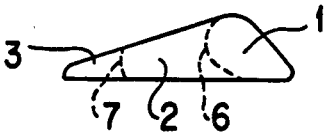
FIG. 3 is a side view of the pillow of the present invention.

The dotted lines 6, 7 9 and 10 of FIGS. 1, 2 and 3 of the Single Sheet indicate the insertion of walls into the case.

The walls are of fabric and the front compartment has a width preferably equal to the length of an average neck in a given size. It can optionally comprise transverse walls in order to be composed of subcompartments.

The compartments of the pillow can be filled equally well with any bits of elastic materials 14 with a unit volume preferably less than one cubic centimeter, that can be washed and dried in a washing machine through the case and walls which contain them.

It is also possible to fill the compartments of the pillow with synthetic or natural fibers, feathers, down and with any other materials used in pillow making. Currently, small parallelepipeds of high resilience polyether foam whose volume is less than half a cubic centimeter and which withstand high washing temperatures.

The pillow according to the invention preferably has one or more zippers 11, 12 and 13 or the like making it possible to access easily each of the compartments to fill them. Generally, fasteners are preferred that remain well closed during washing in a washing machine and that withstand the most used detergents.

The more or less large density of the filling of each compartment makes it possible to obtain a more or less thick pillow and to make the necessary adjustments to adapt the pillow to a particular occipito-cervico-dorsal shape. Whether the user is more or less brachycephalic or dolichocephalic, whether he has a neck that is more or less curved at rest or more or less long, whether his neck extends by a more or less pronounced hollow in the top of his back, whether he needs to have his head more or less raised at rest, the pillow can be specifically adjusted for him, most often by varying the density of the filling of the various compartments.

The case of the new pillow is a wedge of combed cotton or of any other nonallergenic fabric that is permeable to air and water. The side of the fabric that is softest to touch is preferably on the outside to increase comfort.

Figure 4:
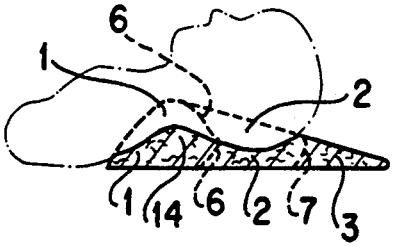
FIG. 4 shows the plurality of the present invention in use.

In contrast with a rack, the pillow is used as indicated in FIG. 4. The convex and high part is made to fit under the neck of the subject and the back low part is straight so that a headboard can optionally prevent the pillow from being pushed out of its good support position.

The better adjusted the pillow is to the occipito-cervico-dorsal shape of the subject the more complete the relaxation of his cervico-dorsal region will be when he uses it. An easier falling asleep and a gradual elimination of sleep disorders, cervicalgias, scapular pains and backache, when they are connected to cervico-scapular hypertonias, i.e., in the majority of the cases observed, have been noted with users of the pillow according to the invention.

This invention is not limited to the embodiments described. It includes all variants within the scope of a person skilled in the art.

I claim:

1. An orthopedic pillow for use by a human being provided with a cervical region, said pillow having a front face and a back face, on which the cervical region of the human being rests, said pillow further provided with a convex face transversely with respect to the height of the pillow, higher than said back face of the pillow and inclined in relation to the vertical of said back face of the pillow, the interior of the pillow provided with a front compartment and two walls parallel to said front face, said front compartment exhibiting a width equal to the length of the average neck of a human being in a given size, each of said compartments accessible by a zipper, and each of said compartments filled with bits of elastic material with a unit volume of each of said bits being less than one cubic centimeter.

2. The orthopedic pillow according to claim 1, wherein at least said front compartment includes transverse walls.

3. The orthopedic pillow in accordance with claim 2, wherein said back face is transversely straight.

4. The orthopedic pillow in accordance with claim 2, wherein said pillow is additionally filled with small parallelepipeds of polyether foam with a unit volume of each parallelepiped being less than half a cubic centimeter.

5. The orthopedic pillow in accordance with claim 1, wherein said back face is transversely straight.

6. The orthopedic pillow in accordance with claim 5, wherein said pillow is additionally filled with small parallelepipeds of polyether foam with a unit volume of each parallelepiped being less than half a cubic centimeter.

7. The orthopedic pillow in accordance with claim 1, wherein said pillow is additionally filled with small parallelepipeds of polyether foam with a unit volume of each parallelepiped being less than half a cubic centimeter.

* * * * *